US006522234B1

(12) United States Patent
Sturgill

(10) Patent No.: US 6,522,234 B1
(45) Date of Patent: Feb. 18, 2003

(54) PLUG-IN FUSE

(76) Inventor: Edward G. Sturgill, 6353 County Line Rd., Lula, GA (US) 30554

( * ) Notice: Subject to any disclaimer, the term of this patent is extended or adjusted under 35 U.S.C. 154(b) by 114 days.

(21) Appl. No.: 09/638,636

(22) Filed: Aug. 14, 2000

(51) Int. Cl.[7] ..... H01H 85/175; H01H 85/153; H01H 85/30

(52) U.S. Cl. ..... 337/198; 337/255; 337/206; 337/243; 337/186

(58) Field of Search ..... 337/255, 159, 337/225, 186, 187, 198, 227, 228, 241, 243, 244, 245, 206; 29/623; 361/104, 835; 81/3.8

(56) References Cited

U.S. PATENT DOCUMENTS

| | | | | | |
|---|---|---|---|---|---|
| 3,813,626 | A | * | 5/1974 | Cetola et al. | 174/138 F |
| 4,164,726 | A | * | 8/1979 | Weibe | 337/215 |
| 4,258,350 | A | * | 3/1981 | Watanabe et al. | 337/198 |
| 4,308,516 | A | | 12/1981 | Shimada et al. | 337/241 |
| 4,391,485 | A | * | 7/1983 | Urani | 337/198 |
| 4,544,907 | A | * | 10/1985 | Takano | 337/262 |
| 4,604,602 | A | * | 8/1986 | Borzoni | 337/198 |
| 4,670,729 | A | | 6/1987 | Oh | 337/264 |
| 4,772,219 | A | * | 9/1988 | Falchetti | 337/266 |
| 4,792,311 | A | * | 12/1988 | Wu | 337/197 |
| 4,884,050 | A | * | 11/1989 | Kozel | 337/255 |
| 5,418,515 | A | * | 5/1995 | Reyes | 337/206 |
| 5,559,662 | A | | 9/1996 | Happ et al. | 361/104 |
| 5,598,138 | A | | 1/1997 | Jaronczyk, Jr. | 337/265 |
| 5,662,496 | A | * | 9/1997 | Kanamori | 337/186 |
| 5,841,337 | A | * | 11/1998 | Douglass | 337/159 |

FOREIGN PATENT DOCUMENTS

| | | | | | |
|---|---|---|---|---|---|
| GB | 2090081 | A | * | 6/1982 | H01H/85/54 |

* cited by examiner

*Primary Examiner*—Anatoly Vortman
(74) *Attorney, Agent, or Firm*—Kenneth S. Watkins, Jr.

(57) ABSTRACT

A plug-in fuse 200 comprises a body 201 with side indented portions 203 which allow secure gripping by the thumb and finger of a hand. The side indented portions define upper and lower extended portions 319, 321 allowing insertion and retraction forces to be exerted on the fuse. The improved body shape allows quick and easy insertion of the fuse in high-density fuse holders. A temperature-responsive material 323 in close proximity to the burnout portion of the fuse element provides visual and/or tactile indication of fuse condition.

4 Claims, 3 Drawing Sheets

PLUG-IN FUSE

BACKGROUND OF THE INVENTION

The present invention relates to electrical fuses and, more particularly, to plug-in fuses with simplified methods to determine fuse condition.

Electrical fuses provide reliable and economical protection for electrical wiring and components. Because of their small size and low cost, plug-in fuses have found wide use in industrial and consumer products such as automobiles, aircraft, air conditioning and heating equipment.

Due to the complexity of such applications, manufacturers often utilize fuse blocks or holders having multiple fuse receptacles. In order to minimize space requirements, fuse receptacles are densely packed, allowing minimal space for inspection, insertion and removal of the fuses. Component packaging often dictates placement of the fuse holders in inaccessible areas, increasing the problem of accessing individual fuses for troubleshooting, testing, and replacement.

In the past, inspection of a fuse to determine its condition required removal of the fuse and subsequent testing of the fuse with a meter such as a volt-ohm meter. The removal, testing and re-insertion of a fuse, especially if the fuse holder is in an inconvenient location, can become a tedious chore, increasing the time and cost for troubleshooting and repair of equipment. Close spacing of fuses often requires use of a tool to aid in the removal and/or insertion of the fuse. Such requirement for specialized tools and equipment prevents inexperienced users from performing an otherwise simple task.

Various fuse designs have been introduced to address the problem of inspecting the condition of a fuse, and to make the fuse easier to remove and re-install. U.S. Pat. No. 4,604,602 discloses a plug-in fuse with an overhanging upper portion to improve grasping of the fuse. U.S. Pat. No. 4,670,729 discloses a plug-in fuse with a transparent case to allow visual determination of the condition of the fuse link. U.S. Pat. No. 4,308,516 discloses a plug-in fuse with a high-resistance, heat responsive member which changes color upon heating. U.S. Pat. No. 5,598,138 discloses a fault-indicating blade fuse utilizing a LED or incandescent bulb which lights upon opening of the fuse element.

Despite a significant number of fuse designs introduced, there remains a significant need for improvement in fuse condition monitoring and fuse removal/insertion features.

OBJECTS AND SUMMARY OF THE INVENTION

Therefore an object of the present invention is to provide a plug-in fuse which can be easily removed and inserted into a high-density fuse holder without the need for special tools or equipment.

A further object of the present invention is to provide a plug-in fuse for automotive, aircraft, industrial equipment and consumer equipment with multiple means to quickly determine the fuse condition without special tools or equipment.

A further object of the present invention is to provide a plug-in fuse which utilizes the heat produced by the burnout of the burnout portion to produce a visual indication of fuse condition.

A further object of the present invention is to provide a plug-in fuse which utilizes the heat produced by the burnout of the burnout portion to produce a tactile indication of fuse condition.

A further object of the present invention is to provide a plug-in fuse with a transparent body to provide a visual indication of fuse condition.

Another object of the present invention is to provide a fuse in which the condition can be determined, and replacement made if necessary, by a person of limited experience.

The fuse of the current invention comprises a fusible link or burnout portion, and at least two terminals connected to the burnout portion by connecting portions. The burnout portion is enclosed in a fuse body and the two terminals extend from the bottom of the fuse body in the preferred embodiments. The shape of the fuse body is necked between the top and bottom of the fuse body by a side-indented portion on each side of the fuse. The side-indented portions provide grip surfaces for the thumb and finger of a hand. Side-extended portions above and below the side-indented portions provide ledge surfaces which allow push forces to be exerted by the thumb and finger to insert the fuse in a fuse holder, and for pull forces to be exerted by the thumb and finger to remove the fuse from the holder. Similarly, the front and back faces of the fuse may be necked to allow gripping of the fuse body by the faces.

In the preferred embodiments, the top portion of the fuse contains a heat or temperature-responsive material in close proximity to the burnout portion. Heat from burnout of the burnout portion conducted to the temperature-responsive material raises the temperature of the temperature-responsive material sufficiently to provide visual and/or tactile changes in the temperature-responsive material. The temperature-responsive material may be disposed as a layer on the upper portion of the body or, alternatively, the upper portion of the body, a substantial portion, or the entire body may be made of the temperature-responsive material. In other embodiments, the burnout portion may be in contact with the temperature-responsive material. In still other embodiments, a heat-conductive material may be disposed between the burnout portion and the temperature-responsive material. In the preferred embodiments, the body portions comprising the temperature-responsive materials are on the top of the fuse, or another external surface of the fuse which is easily seen, and/or felt by, a user when installed.

The temperature-responsive material may be a material which degrades to produce tactile changes on the surface of the body of the fuse. Or, the temperature-responsive material may be a material which decomposes to form discolored gaseous or particulate products observable in a chamber enclosing the burnout portion of the fuse element.

In the preferred embodiments, a cavity in the body encloses the burnout portion. The body of the fuse is made of a transparent or translucent material to allow visual observation of the condition of the burnout portion or discolored burnout components or gas. External electrical contacts, connected to the connecting portions of the burnout portion, allow electrical testing of the fuse without removal of the fuse from the fuse holder.

BRIEF DESCRIPTION OF THE DRAWINGS

These and other features, aspects and advantages of the present invention will become better understood with regard to the following description, appended claims and accompanying drawings where:

DESCRIPTION OF THE PREFERRED EMBODIMENTS

The following is a description of the preferred embodiments of a plug-in fuse with improved grip for quick insertion and removal in fuse holders.

Figure 1:
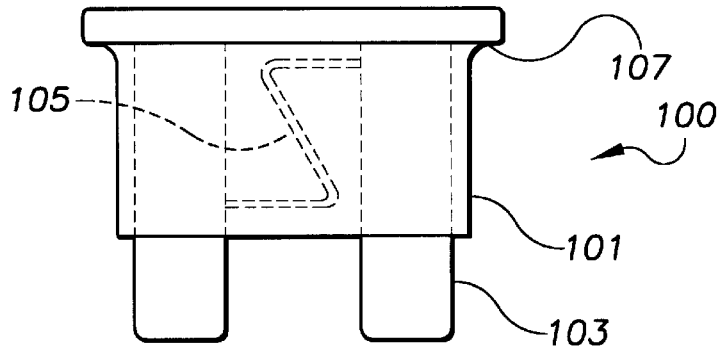
FIG. 1 PRIOR ART
FIG. 1 is a front elevation drawing of a plug-in fuse of a prior art design having a burnout portion enclosed by a body with a single gripping ledge.

FIG. 1 is an elevation drawing of a typical plug-in fuse 100 of prior art commonly used in automotive and commercial applications. The prior art fuse comprises a body 101, terminals 103 and a fusible link or burnout portion 105. Body 101 comprises a single ledge surface 107, used to grip the fuse for removal and insertion. Fuses of this general type are difficult to remove from a fuse block, especially if the fuse packing density is large.

Figure 2:
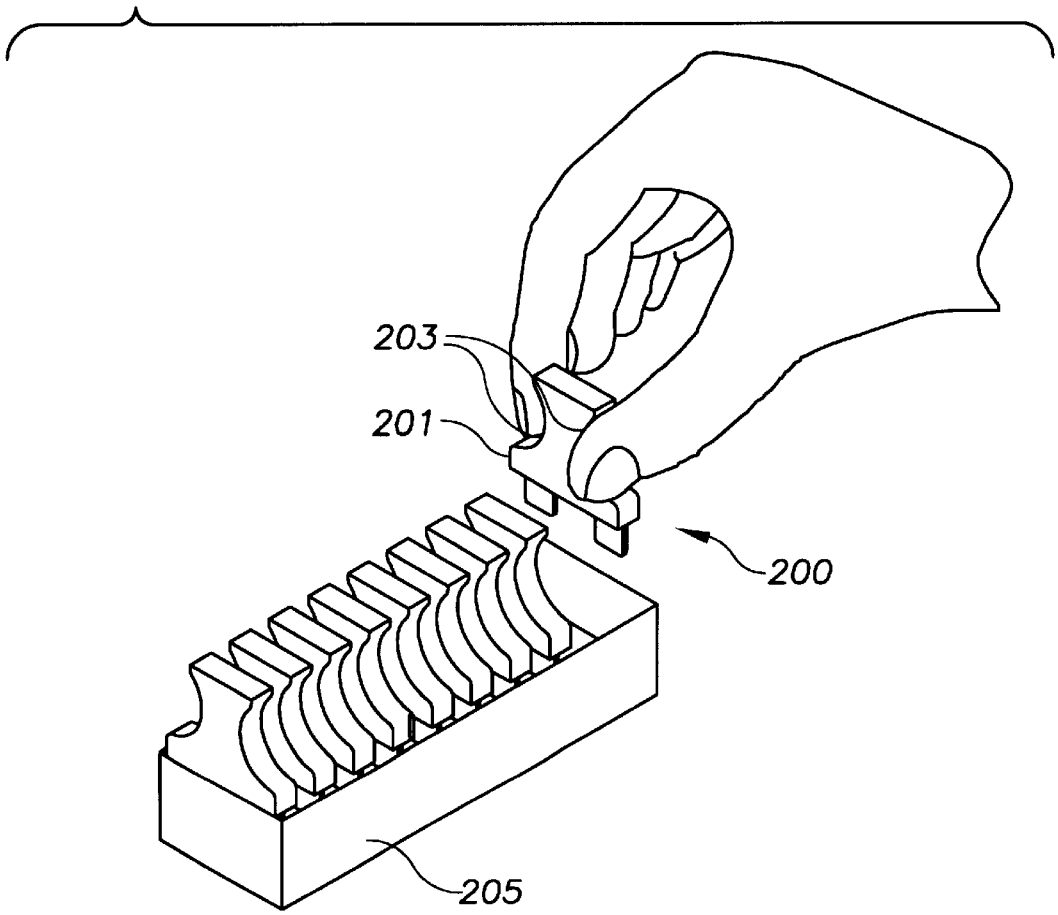
FIG. 2 is a perspective drawing of a plug-in fuse of the present invention having side-indented portions for gripping with a thumb and finger of a hand, the plug-in fuse being inserted into a fuse holder.

FIG. 2 is a perspective drawing of a preferred embodiment of a plug-in fuse 200 of the present invention. Side-indented portions 203 of body 201 provide recesses in the side of fuse body 201, allowing secure gripping of fuse 200 for insertion and removal of fuse 200 in holder 205.

Figure 3A:
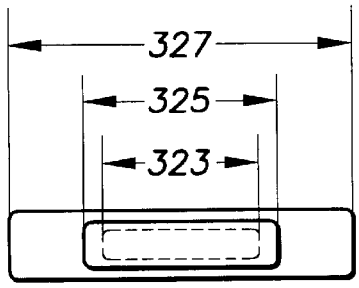
FIG. 3A is a top view of an embodiment of the plug-in fuse of the present invention having side-indented portions, top and bottom side-extended portions, and a burnout portion enclosed by the body of the fuse, the figure showing the relative widths of the side indented portions, the side extended portions, and the thickness.
Figure 3B:
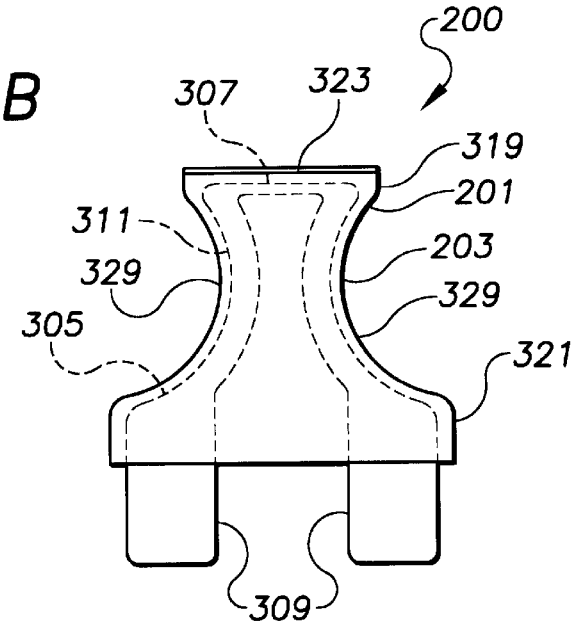
FIG. 3B is a front elevation drawing of the plug-in fuse of FIG. 3A.
Figure 3C:
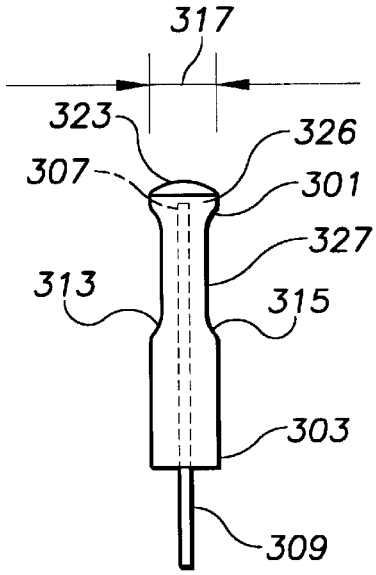
FIG. 3C is a side elevation drawing of the plug-in fuse of FIGS. 3A and 3B.

FIGS. 3A, 3B and 3C are top, front and side views, respectively, of the fuse of FIG. 2. Fuse 200 comprises body 201 having an upper body portion 301 and a lower body portion 303. Fuse element 305 comprises a burnout portion 307, two terminals 309 extending downward from lower body portion 303, and fuse connecting portions 311 connecting terminals 309 with burnout portion 307.

In the preferred embodiments, fuse burnout portion 307, fuse connecting portions 311, and the upper portions of fuse terminals 309 are encapsulated in fuse body 201. Body 201 may be molded or die cast around fuse element 305, or, body 201 may be a multi-part structure assembled with fuse element 305 interior to body 201.

Body 201 comprises a front face portion 313 and back face portion 315 defining thickness 317. Thickness 317 may be a uniform thickness over the front and back faces, or it may be a maximum thickness as shown in FIG. 3C.

As best seen in FIG. 3B, sides 329 of body 201 comprise upper side extended portions 319, side indented portions 203, and lower side extended portions 321. The width 323 of side indented portion 203 is less than the width 325 of upper side extended portion 319 and the width 327 of lower side extended portion 321. The maximum width dimension, normally width 327 of lower extended portion 321, is greater that maximum body thickness 317.

Side indented portion 203, having a width less than upper side extended portion 319 and lower side extended portion 321 provides secure grip surfaces for the thumb and finger of a hand in inserting and removing fuse 200 from a fuse holder. Extended portion 319 provides an extension or ledge for the thumb and finger to exert a pulling or removal force on body 201. Extended portion 321 provides an extension or ledge for the thumb and finger to exert a push or insertion force to be exerted on fuse body 201. In other embodiments, face indented portion 327 of FIG. 3 has reduced thickness as compared to upper body portion 301 and lower body portion 303 to aid in insertion and removal of fuses when face-to-face clearance allows.

A condition-indicating layer 323, adjacent to burnout portion 307 provides a thermally induced indication of burnout or opening of burnout portion 307. Heat generated by excessive current through burnout portion 307 is transmitted to layer 323 by thermal conduction of body portion 326 and proximity of burnout portion 307 to layer 323.

Condition-indicating layer 323 may be a material which provides a thermally induced coloration or light transparency change in the material. Temperature-responsive materials which degrade to produce permanent color changes upon overtemperature are known in the art and include thermosetting plastics such as epoxies. An example of materials which provide coloration change upon overtemperature are acrylic enamels and lacquers.

Condition-indicating layer 323 may also be a temperature-responsive material which produces changes in the layer that can be detected tactilely, for example by the fingers of one's hand. In a preferred embodiment, layer 323 is a polymeric material with a thermal degradation temperature less than, or equal to, the temperature attained in layer 323 due to burnout of burnout portion 307. The temperature-responsive layer is a material such as a thermally degradable material selected to produce bubbling, wrinkling, or other roughness or surface irregularities (451 of FIG. 4A) upon reaching the temperature resulting from fusible link burnout. In this manner, touching of the layer 323 on the top of the fuse 200 provides an indication of the condition of the fuse.

In the preferred embodiments, the thermal degradation temperature of the material of layer 323 is chosen to be less than the thermal degradation temperature of body portion 326. In still other embodiments, body 201 is made of the temperature-responsive material and layer 323 is integral to body 201. Thermosetting polymers have been found to produce a tactile-detectable roughness when exposed to the heat of fuse link burnout. An example of materials which produce tactile-detectable roughness when exposed to overtemperature resulting from fuse link burnout include acrylic lacquers and epoxies. Other paint and coating materials have been found to provide tactile-detectable roughness when exposed to elevated temperatures.

Figure 4:
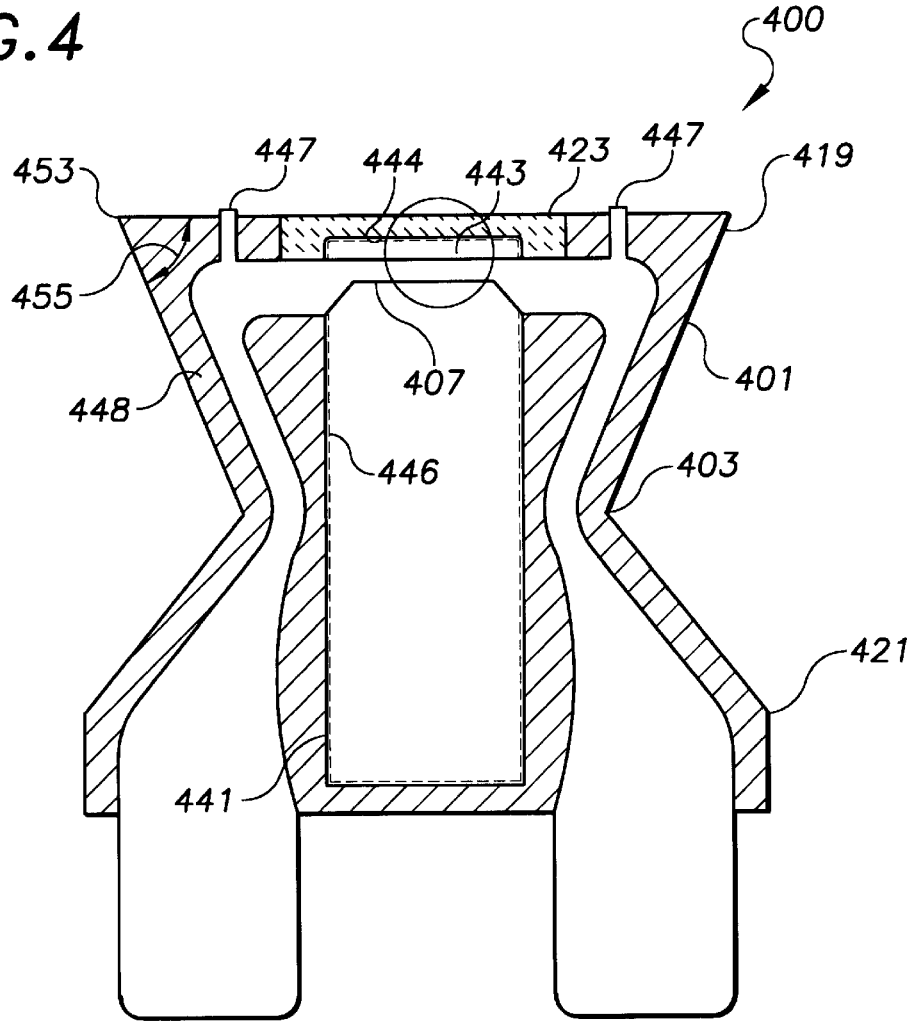
FIG. 4 is a front cross-sectional view of an alternative embodiment of the fuse of the present invention showing the proximity of the burnout portion to the temperature-responsive material to provide visual and tactile indication of the fuse condition.

FIG. 4 is a side elevation drawing of fuse 400 showing fuse body 401 with upper side extended portion 419, side indented portion 403, and lower side extended portion 421. In the preferred embodiments, fuse 400 comprises an air space or chamber 441 internal to fuse body 401 which encompasses burnout portion 407. Chamber 407 provides volume for fusible link 407 material when melted and reduces heat transfer to body 401. Chamber 441 also provides an expanded volume for visual materials resulting from burnout of burnout portion 407 such as burned particulate matter and gasses. Close proximity of burnout portion 407 to temperature-responsive material 423 provides sufficient temperature change in material 423 to provide the desired visual or tactile response discussed in the previous embodiment. In other embodiments, burnout portion 407 contacts temperature-responsive material 423. In still other embodiments, most or all of body 401 is made of a thermally responsive material.

Figure 4A:
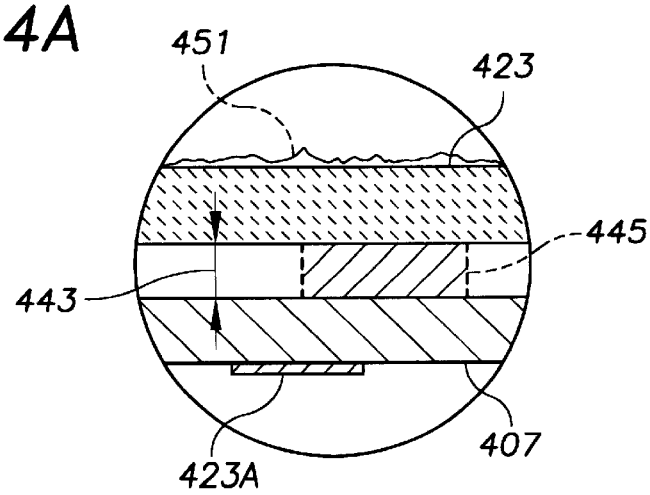
FIG. 4A is a detail cross-sectional drawing of the burnout portion and temperature-responsive material portion of FIG. 4 and showing the optional thermal coupling element coupling heat from the burnout portion to the temperature-responsive material.

As best seen in FIG. 4A, spacing 443 between burnout portion 407 and temperature-responsive material 423 is chosen to provide sufficient transfer of thermal energy to material 423 to provide the desired effect, either visual or tactile, or both. In the preferred embodiments, spacing 443 is less than 0.20". In more preferred embodiments, spacing 443 is less than 0.10", and in still more preferred embodiment, spacing 443 is less than 0.05". In an alternative embodiment, burnout portion 407 contacts temperature-responsive material 423, or it may be partially or fully embedded in material 423. In still other embodiments, a thermal-coupling material 445 such as a metallic, ceramic or polymeric material with a high thermal conductivity may be used to transfer heat from burnout portion 407 to temperature-responsive material 423. Thermal-coupling material 445 allows placement of a temperature-responsive material indicator on another portion of the fuse, such as the side of the fuse body, etc.

Still another condition-indicating feature of the plug-in fuse of the present invention is a "clouding" or discoloration within chamber 441 due to gaseous and particulate matter formed upon decomposition of temperature-responsive material 423. Material 423 may be a thermally decomposable material chosen to produce discolored gasses and particulate matter when heated due to the proximity of burnout portion 407 to surface 444 of temperature-responsive material 423. Production of discolored particulate material results in condensing of the material as a discolored film 446 on the surface of chamber 441. The discolored film 446 is visible through transparent or translucent body material 448. Discolored gasses, trapped in chamber 441 also produce a "clouding" of the chamber visible through material 448. In an alternative embodiment, a temperature-responsive material 423A producing discolored gasses and/or particulate matter may be disposed on burnout portion 407 as shown in FIG. 4A. Material 423 and 423A may be organic material comprising carbon to produce the desired discoloration by-products. Examples of materials producing desired discoloration by-products upon degradation of heat resulting from burnout of the burnout portion are acrylic lacquers and epoxies.

Body 401 may be molded, cast, formed or fabricated from appropriate materials such as plastic. In the preferred embodiments, body 401 material is a transparent plastic material tinted to indicate fuse rating. Use of a transparent or translucent plastic allows visual inspection of burnout portion 407 and observation of burned materials resulting from burnout of burnout portion 407. External electrical contacts 447, extending from either side of burnout portion 407 provide an electrical method to check burnout portion 407. A sharp corner 453 at the upper extended portion 419 of fuse body provides improved grip of the fuse. Included angle 455 of corner 451 may be chosen less than 90 degrees to further improve grip.

Accordingly the reader will see that the PLUG-IN FUSE of the current invention provides a fuse for quick and convenient removal and insertion in high-density fuse holders. The device provides the following additional advantages:

The fuse provides both visual and tactile indication of fuse burnout, reducing time required to determine the fuse condition;

No special tool or equipment are needed to remove, insert, or check indication of the fuse;

The fuse replaces existing plug-in fuses; and

The fuse is simple and low in cost

Although the description above contains many specifications, these should not be construed as limiting the scope of the invention but as merely providing illustrations of some of the presently preferred embodiments of this invention. Thus the scope of the invention should be determined by the appended claims and their legal equivalents, rather than by the examples given.

I claim:

1. A plug-in fuse for protecting electrical circuits, the fuse insertable and removable from a fuse holder, the fuse comprising:

a body comprising two side portions defining a maximum width dimension, two face portions defining a maximum thickness dimension, an upper body portion and a lower body portion, the maximum width dimension being greater than the maximum thickness dimension;

a fuse element disposed in the body, the fuse element comprising a burnout portion connected to at least two terminals extending from the lower body portion;

each of said two side portions comprising a full-thickness side indented portion, an upper side extended portion and a lower side extended portion;

a first width separating the side indented portion of said two side portions, the first width being less than a second width separating the upper side extended portion of said two side portions and a third width separating the lower side extended portion of said two side portions;

said side indented portion defining a grip surface for a finger and thumb of a hand with the upper side extended portion allowing a withdrawal force and the lower side extended portion allowing an insertion force by said finger and thumb of a hand.

2. The plug-in fuse of claim 1 wherein the body comprises a first temperature-responsive portion, the first temperature-responsive portion comprising a first polymeric material which causes surface irregularities on a surface of the temperature-responsive portion when exposed to heat produced upon burnout of the burnout portion, the surface irregularities providing a tactile indication of fuse burnout.

3. The plug-in fuse of claim 1 comprising a first temperature-responsive portion, the first temperature-responsive portion comprising a polymeric material which causes a permanent color change in the polymeric material when exposed to heat produced upon burnout of the burnout portion, the color change providing a visual indication of fuse burnout.

4. The plug-in fuse of claim 1 wherein the second width is less than the third width.

* * * * *